US009395668B2

(12) United States Patent
Sugiyama et al.

(10) Patent No.: US 9,395,668 B2
(45) Date of Patent: Jul. 19, 2016

(54) PRESSURE-APPLYING FIXING ROLLER AND FIXING DEVICE

(71) Applicant: SYNZTEC CO., LTD., Tokyo (JP)

(72) Inventors: Yuji Sugiyama, Tokyo (JP); Takeyoshi Tedori, Tokyo (JP); Masaya Suzuki, Tokyo (JP)

(73) Assignee: SYNZTEC CO., LTD., Tokyo (JP)

( * ) Notice: Subject to any disclaimer, the term of this patent is extended or adjusted under 35 U.S.C. 154(b) by 0 days.

(21) Appl. No.: 14/879,530

(22) Filed: Oct. 9, 2015

(65) Prior Publication Data

US 2016/0103407 A1 Apr. 14, 2016

(30) Foreign Application Priority Data

Oct. 9, 2014 (JP) ..... 2014-208381

(51) Int. Cl.
*G03G 15/20* (2006.01)

(52) U.S. Cl.
CPC ..... *G03G 15/2089* (2013.01)

(58) Field of Classification Search
CPC ..... G03G 15/2089; G03G 15/2053; G03G 15/0886; G03G 15/0233; G03G 15/0868; G03G 15/161; G03G 2215/2035
USPC ..... 399/333
See application file for complete search history.

(56) References Cited

U.S. PATENT DOCUMENTS

2009/0047048 A1* 2/2009 Ikeda ..... G03G 15/2057 399/333
2010/0310290 A1* 12/2010 Sugawara ..... F16C 13/00 399/333
2013/0045034 A1* 2/2013 Yoshida ..... G03G 15/2057 399/333
2014/0356040 A1* 12/2014 Sakakibara ..... G03G 15/2057 399/333

FOREIGN PATENT DOCUMENTS

| | | |
|---|---|---|
| JP | 2003-345158 | 12/2003 |
| JP | 3506543 | 12/2003 |
| JP | 3642890 | 2/2005 |
| JP | 4342229 | 7/2009 |

* cited by examiner

*Primary Examiner* — Walter L Lindsay, Jr.
*Assistant Examiner* — Jessica L Eley
(74) *Attorney, Agent, or Firm* — Young & Thompson

(57) ABSTRACT

To provide a fixing pressure roller which can be readily produced through molding and which has excellent durability, low hardness and low heat capacity, and a fixing device employing the fixing pressure roller. In the fixing pressure roller for employment in a fixing unit of a fixing device, the fixing pressure roller has a core, and an elastic layer provided around the core, wherein the elastic layer is formed of a foamed silicone rubber which is a foam curing product of an unvulcanized silicone rubber containing a chemical foaming agent, and has a mean cell diameter of 50 μm to 150 μm.

8 Claims, 6 Drawing Sheets

FIG.6

| | Ex. 1 | Ex. 2 | Comp. Ex. 1 | Comp. Ex. 2 |
|---|---|---|---|---|
| Cross-section photoimage | | | | |
| Mean cell diam. (μm) | 88 | 91 | 232 | 323 |

PRESSURE-APPLYING FIXING ROLLER AND FIXING DEVICE

The entire disclosure of Japanese Patent Application No. 2014-208381 filed on Oct. 9, 2014 is expressly incorporated by reference herein.

BACKGROUND OF THE INVENTION

1. Field of the Invention

The present invention relates to a pressure-applying fixing roller (hereinafter referred to as a "fixing pressure roller") and to a fixing device having the fixing pressure roller.

2. Background Art

A fixing unit of a copying machine or a printer employs a roller, and examples of the roller include a roller made of a metallic (iron, aluminum, etc.) core and an elastic layer (silicone rubber) (hereinafter referred to as fixing roller), and a roller made of a metallic core, an elastic layer, and a release layer (fluororesin tube) (hereinafter referred to as a pressure roller). Generally, the elastic layer of such a fixing pressure roller is made of foamed silicone rubber. Foamed silicone rubber has low hardness and ensures a wide fixation width, and has such a low heat capacity that the heat of a heat source built in a fixing roller or a fixing belt facing the elastic layer is not readily transferred thereto.

Such foamed silicone rubber is generally produced via a chemical foaming process, in which a foaming agent is incorporated in advance into a base rubber, and the foaming agent is gasified through heating. However, difficulty is encountered in controlling the foaming process during rubber curing, and provided cells are not uniform in size and shape, which is problematic. Thus, a further problem arises in that breakage of cells (foams) proceeds, to thereby cause poor hardness. That is, the produced silicone rubber foam has problematically insufficient durability. From another aspect, in a recent trend of reduction in particle size of toner, such foamed silicone rubber is not sufficient in realization of enhancement in quality of printed images and in high resolution. Thus, these problems remain to be solved.

One technique proposed to solve the problems is forming microcells by pressurizing a gas such as carbon dioxide under a pressure higher than the critical pressure thereof, to thereby disperse the gas in rubber, and by rapidly reducing the pressure to provide foam (see Patent Documents 1 and 2).

However, the technique also has a problem. Foam provided in unvulcanized rubber is released with the lapse of time, and therefore, difficulty is encountered in setting and controlling the curing time and other curing conditions. In some cases, most of the foam disappears.

In order to solve the above problem, there has been proposed a technique in which two or more curing agents having different reacting temperatures are added to a rubber base, and the rubber base is pressurized in a semi-vulcanized state while one curing agent has been consumed. In this case, no bubbles remain in the cured portion, and difficulty is encountered in realizing low hardness and low heat capacity.

Thus, there has been proposed another technique for attaining small cell diameter and low hardness, the technique including controlling the degree of plasticity (hereinafter referred to as "plasticity degree") of unvulcanized rubber (see Patent Documents 3 and 4).

However, an unvulcanized rubber whose plasticity degree has been modified is difficult to mold. In addition, curing rate of the rubber and decomposition rate of the organic foaming agent must be precisely regulated.

Under such circumstances, there is demand for a technique for readily molding foamed silicone rubber and providing small cells while the rubber maintains low hardness and low heat capacity.

Patent Document 1: Japanese Patent No. 3506543
Patent Document 2: Japanese Patent No. 3642890
Patent Document 3: Japanese Patent No. 4342229
Patent Document 4: Japanese Patent Application Laid-Open (kokai) No. 2003-345158

SUMMARY OF THE INVENTION

In view of the foregoing, an object of the present invention is to provide a fixing pressure roller which can be readily produced through molding and which has low hardness and low heat capacity. Another object is to provide a fixing device employing the fixing pressure roller.

In a first mode of the present invention for attaining the aforementioned objects, there is provided a fixing pressure roller for employment in a fixing unit of a fixing device, the fixing pressure roller comprising a core, and an elastic layer provided around the core, wherein the elastic layer is formed of a foamed silicone rubber which is a foam curing product of an unvulcanized silicone rubber containing a chemical foaming agent, and has a mean cell diameter of 50 μm to 150 μm.

In one embodiment of the fixing pressure roller, the unvulcanized silicone rubber is molded, the plasticity degree of the unvulcanized silicone rubber is adjusted to 250 to 450, and then the unvulcanized silicone rubber is foaming-cured.

In the fixing pressure roller, the unvulcanized silicone rubber may have a plasticity degree of 150 or higher and lower than 250, before molding.

In the fixing pressure roller, the elastic layer may have a release layer on a surface thereof.

In a second mode of the present invention, there is provided a fixing device having any of the aforementioned fixing pressure rollers.

According to the present invention, a fixing pressure roller having excellent durability and low hardness and low heat capacity, and a fixing device employing the fixing pressure roller can be realized.

BRIEF DESCRIPTION OF THE DRAWINGS

Various other objects, features, and many of the attendant advantages of the present invention will be readily appreciated as the same becomes better understood with reference to the following detailed description of the preferred embodiments when considered in connection with the accompanying drawings, in which:

FIG. 6 provides microscopic photoimages of the elastic layers of Examples and Comparative Examples.

DETAILED DESCRIPTION OF PREFERRED EMBODIMENTS

Embodiments of the present invention will next be described in detail.

Embodiment 1

The fixing pressure roller of the present invention is employed for fixing an unfixed toner imager onto a recording medium by means of heat and pressure in a fixing unit of an image-forming apparatus. As described hereinbelow, the fixing pressure roller may be applied to, for example, a pressure roller or a fixing roller. In Embodiment 1, the fixing pressure roller is employed as a pressure roller.

Figure 1A:
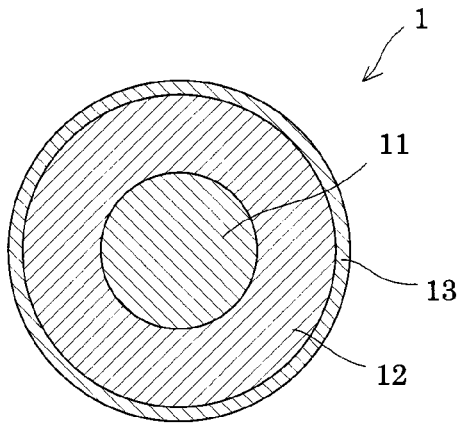
FIG. 1A is a transverse cross-sectional view of a pressure roller according to Embodiment 1.
Figure 1B:
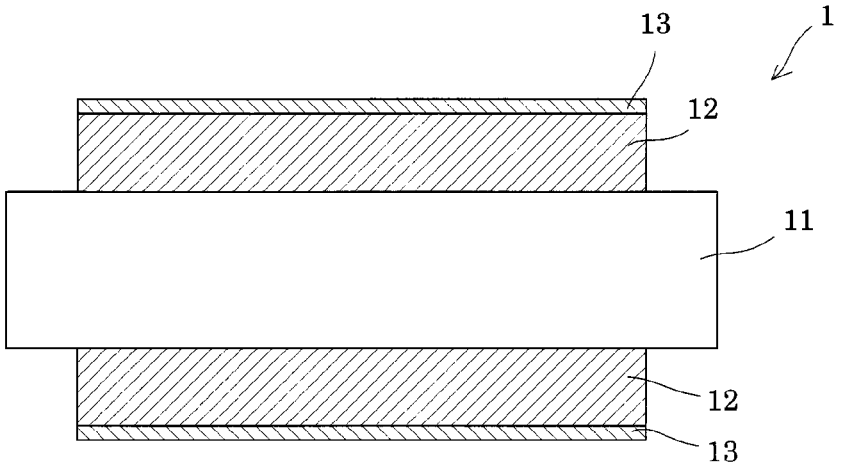
FIG. 1B is a longitudinal cross-sectional view of the same pressure roller.

FIG. 1A is a transverse cross-sectional view of a pressure roller according to Embodiment 1, and FIG. 1B is a longitudinal cross-sectional view of the same pressure roller. A pressure roller 1 includes a core 11, an elastic layer 12 provided around the core 11, and a release layer 13 provided on the elastic layer 12.

In the present invention, the elastic layer 12 is formed of a silicone rubber product formed by mixing a raw silicone rubber with a chemical foaming agent, extruding the mixture, adjusting the plasticity degree of the extrusion-molded product, and curing the raw silicone rubber. The silicone rubber product has a very small mean cell diameter of 50 μm to 150 μm, which has been adjusted by adding a chemical foaming agent into the raw silicone rubber and controlling the plasticity degree and conditions for vulcanization.

The mean cell diameter is obtained by observing a cross-section of a sample under a microscope and performing calculation. The cell diameter is the square root of a product of the longitudinal length of a cell and the lateral length of the cell. The mean cell diameter employed in the invention is a median of the measurements of 50 cells.

When the plasticity degree is elevated before molding, extrusion molding becomes difficult. In contrast, when unvulcanized silicone rubber is mixed with a chemical foaming agent and molded under specific conditions, the plasticity degree of the molded product can be elevated by merely allowing the product to stand under specific conditions, and the foamed condition can be maintained. No particular limitation is imposed on the temperature and humidity at which the molded rubber is allowed to stand, and conditions under which foaming reaction or vulcanization reaction does not proceed are preferred. For example, this treatment may be performed at 5 to 40° C.

In a preferred mode, the plasticity degree of the unvulcanized silicone rubber before molding is adjusted to 150 or higher and lower than 250, and after completion of molding, to 250 to 450, and then foam curing is performed.

The thus-plasticity degree-adjusted unvulcanized silicone rubber is subjected sequentially to primary vulcanization and secondary vulcanization, whereby the elastic layer 12 of interest is formed.

No particular limitation is imposed on the conditions for primary vulcanization and secondary vulcanization, which vary depending on the raw materials. However, the conditions must be tuned so that the mean cell diameter is adjusted to 50 μm to 150 μm.

In one example, primary vulcanization is performed at about 150 to about 300° C. for about 15 to about 90 minutes, and secondary vulcanization is performed at about 200 to about 250° C. for about 5 to about 20 hours.

The core 11 of the pressure roller 1 is formed of a metal or a resin material. No particular limitation is imposed on the metal or resin material employed, so long as it can form the core of the pressure roller 1. Also, no particular limitation is imposed on the shape of the core 11, and the core 11 may or may not be hollow.

No particular limitation is imposed on the raw silicone rubber forming the elastic layer 12, so long as the silicone rubber forms an elastic product through thermally curing the raw silicone rubber. Specifically, a millable silicone rubber is used. Such a silicone rubber employed may be a commercially available one. Needless to say, two or more such silicone rubbers may be employed in combination.

No particular limitation is imposed on the chemical foaming agent, and an example is 1,1-azobis(cyclohexane-1-methylcarboxylate). No particular limitation is imposed on the amount of the chemical foaming agent incorporated into the raw silicone rubber. For example, 3 to 8 parts by mass of the chemical foaming agent are added to 100 parts by mass of unvulcanized rubber material.

According to the present invention, the plasticity degree of the elastic layer 12 is adjusted to a specific level after molding, and the thus-treated elastic layer 12 is subjected to primary vulcanization. Thus, the elastic layer can be provided with microcells having a mean cell diameter of 50 μm to 150 μm. Such an elastic layer is useful for a fixing pressure roller having low hardness and low heat capacity.

The thickness of the elastic layer 12 is, for example, 0.5 mm to 20 mm, preferably 2 mm to 6 mm. Such a thickness is employed for enhancing toner fixability and image quality.

The release layer 13 is preferably formed of a synthetic resin material having high releasability, and an example of the material is a fluororesin. Examples of the fluororesin include perfluoroalkoxy fluororesin (PFA), polytetrafluoroethylene (PTFE), tetrafluoroethylene-hexafluoropropylene copolymer (FEP), and tetrafluoroethylene-ethylene copolymer (ETFE). Of these, perfluoroalkoxy fluororesin (PFA) is preferred.

No particular limitation is imposed on the thickness of the release layer 13, so long as the thickness ensures that the fixing pressure roller can be provided with high releasability. For example, the thickness is 10 μm to 100 μm, preferably 20 μm to 50 μm. Notably, provision of the release layer is optional.

The fixing pressure roller of the present invention has the elastic layer 12, which has low hardness over the entirety of the roll and small variation in hardness in the axial direction. Therefore, the fixing unit ensures a wide fixation width, to thereby enhance toner fixability.

Next will be described a method for producing the fixing pressure roller of the present invention.

In the production of the fixing pressure roller, a chemical foaming agent, a vulcanizing agent, and an optional additive are added to a millable silicone rubber, to thereby prepare a millable silicone rubber composition. In this case, the plasticity degree is adjusted to the aforementioned value.

Subsequently, in one technique, the millable silicone rubber composition is extruded onto the outer surface of the core 11, or the core 11 is inserted into the extruded product. The thus-obtained body is allowed to stand under specific conditions or subjected to a similar treatment, to thereby elevate the plasticity degree to the aforementioned value or thereabouts. Then, primary vulcanization is performed, to thereby form the elastic layer 12. Further, the release layer 13 (formed of, for example, a PFA tube) is formed around the elastic layer.

In an alternative technique for employment of a PFA tube, the release layer 13 may be formed through, for example, application of a coating liquid. Notably, instead of forming the elastic layer integrally with the release layer, the elastic layer and the release layer may be produced separately. Needless to say, in both cases, there can be produced a low-heat-capacity fixing pressure roller having low hardness and small variation in hardness in the axial direction.

Next will be described a fixing device.

A fixing device 10 falling within the scope of the present invention is employed in an image-forming apparatus and fixes an unfixed toner image onto a recording medium by means of heat and pressure.

Figure 2:
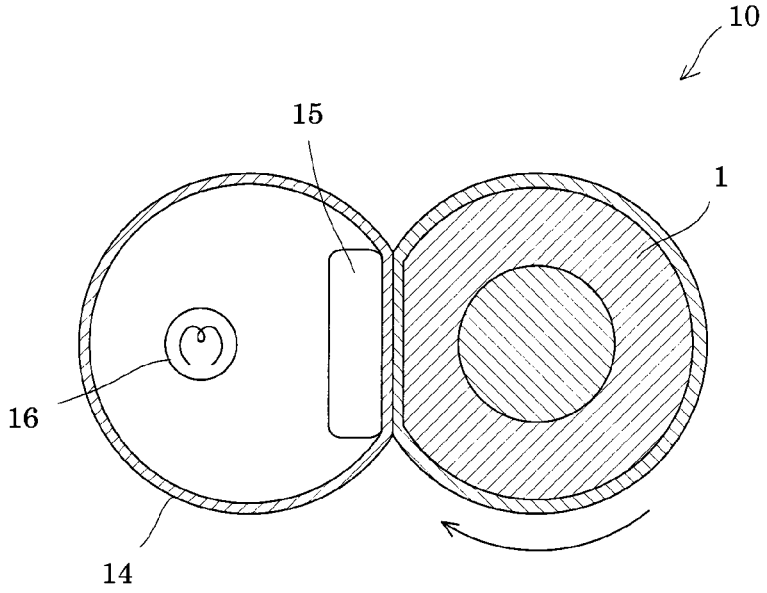
FIG. 2 is a cross-sectional view of a fixing device including the fixing roller and the pressure roller according to Embodiment 1.

FIG. 2 is a schematic cross-sectional view of a fixing device according to Embodiment 1. As shown in FIG. 2, the fixing device 10 includes the pressure roller 1 according to Embodiment 1; a fixing belt 14 provided so as to face the pressure roller 1; a pressure member 15 which is located so as to face the pressure roller 1 and which applies pressure from the inside of the fixing belt 14 to the pressure roller 1, to thereby form a specific nip; and heating means 16 for heating the fixing belt 14 to a specific temperature.

No particular limitation is imposed on the fixing belt 14, so long as it can form a specific nip when it comes into pressure contact with the facing pressure roller 1. For example, the fixing belt 14 includes a metal substrate having at least one seamless electroformed belt; a sliding layer formed on the inner peripheral surface of the metal substrate; an elastic layer formed on the outer peripheral surface of the metal substrate; and a release layer formed on the outer peripheral surface of the elastic layer.

The pressure member 15 is formed of, for example, an elastic material (e.g., rubber), a resin, or a metal. The surface of the pressure member 15 may optionally be provided with a layer formed of a fluororesin or the like, or provided with, for example, a sliding sheet or a groove. The surface of the sliding sheet may be subjected to an embossing process.

No particular limitation is imposed on the heating means 16, so long as it can heat the fixing belt 14. The heating means 16 may be provided on the outside of the fixing belt 14. The heating means 16 may be, for example, a halogen heater, a heating wire heater, an infrared heater, or electromagnetic induction heating by means of an exciting coil (heat source). The heating means 16 may be provided inside of the pressure member 15.

The fixing device 10 of the present invention has the low-heat-capacity pressure roller 1 having low roller hardness with small variation in hardness in the axial direction. Therefore, a sufficiently wide fixation area is ensured in the fixation unit, to thereby enhance toner fixability of the fixation device.

Embodiment 2

In Embodiment 2, the fixing pressure roller is employed as a fixing roller or a pressure roller. The members of the fixing device of Embodiment 2 which are the same as those of Embodiment 1 are denoted by the same reference numerals, and repeated descriptions thereof are omitted.

Figure 3:
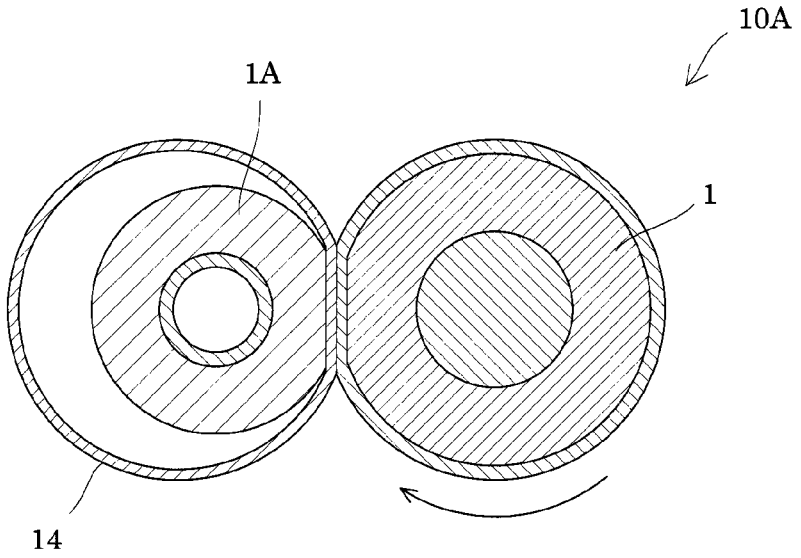
FIG. 3 is a cross-sectional view of a fixing device including the fixing roller and the pressure roller according to Embodiment 2.

FIG. 3 is a schematic cross-sectional view of the fixing device which includes a fixing roller and a pressure roller according to Embodiment 2. As shown in FIG. 3, a fixing device 10A includes the pressure roller 1; a fixing belt 14 provided so as to face the pressure roller 1; and a fixing roller 1A which is provided instead of a pressure member, and which applies pressure from the inside of the fixing belt 14 to the pressure roller 1. Non-illustrated heating means is provided outside of the fixing roller 1A. The fixing pressure roller of the present invention may serve as the fixing roller 1A or as the pressure roller 1, shown in FIG. 4.

Embodiment 3

In Embodiment 3, the fixing pressure roller is employed as an inner roller or a pressure roller. The members of the fixing device of Embodiment 3 which are the same as those of Embodiment 1 are denoted by the same reference numerals, and repeated descriptions thereof are omitted.

Figure 4:
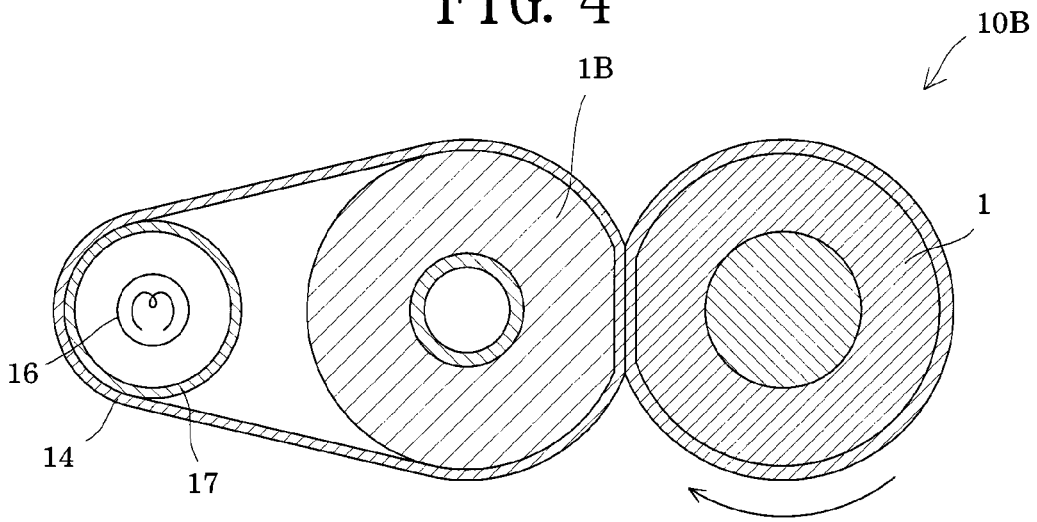
FIG. 4 is a cross-sectional view of a fixing device including the fixing roller and the pressure roller according to Embodiment 3.

FIG. 4 is a schematic cross-sectional view of the fixing device which includes an inner roller and a pressure roller according to Embodiment 3.

As shown in FIG. 4, a fixing device 10B includes the pressure roller 1; a fixing belt 14 provided so as to face the pressure roller 1; an inner roller 1B which applies pressure from the inside of the fixing belt 14 to the pressure roller 1; and a heating roller 17 including therein heating means. The inner roller 1B and the heating roller 17 including therein heating means are disposed inside the fixing belt 14. The fixing belt 14 is rotated by means of the inner roller 1B and the heating roller 17. The fixing pressure roller of the present invention may serve as the inner roller 1B or as the pressure roller 1, in FIG. 4.

Embodiment 4

In Embodiment 4, the fixing pressure roller is employed as a fixing roller or a pressure roller. The members of the fixing device of Embodiment 4 which are the same as those of Embodiment 1 are denoted by the same reference numerals, and repeated descriptions thereof are omitted.

Figure 5:
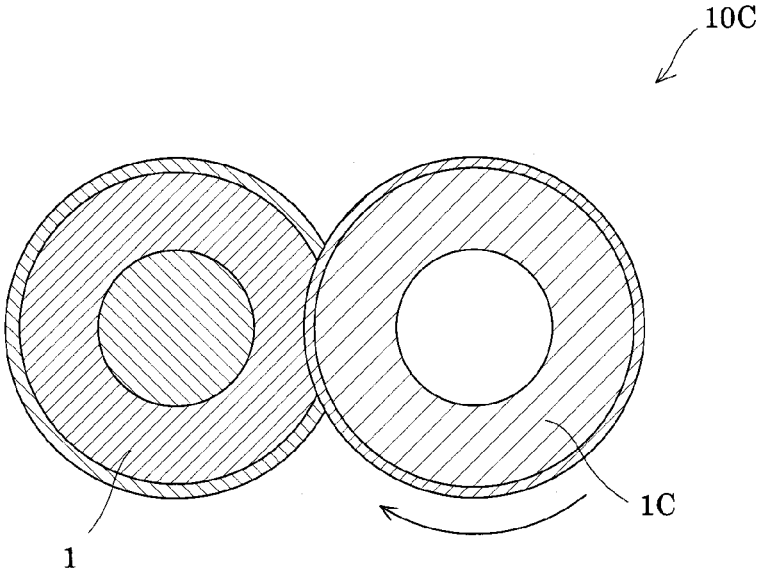
FIG. 5 is a cross-sectional view of a fixing device including the fixing roller and the pressure roller according to Embodiment 4.

FIG. 5 is a schematic cross-sectional view of the fixing device which includes a fixing roller and a pressure roller according to Embodiment 4.

As shown in FIG. 5, a fixing device 10C includes the pressure roller 1, and a fixing roller 1C provided so as to face the pressure roller 1. The fixing roller 1C includes therein non-illustrated heating means. The fixing pressure roller of the present invention may serve as the fixing roller 1C or as the pressure roller 1, shown in FIG. 5.

EXAMPLES

The present invention will next be described in detail by way of examples.

Example 1

To a millable silicone rubber X-30-4037-U (product of Shin-Etsu Chemical Co., Ltd.) (100 parts by mass), there were added a vulcanizing agent C-25B (product of Shin-Etsu Chemical Co., Ltd.) (3 parts by mass), a catalyst C-25A (product of Shin-Etsu Chemical Co., Ltd.) (0.5 parts by mass), a foaming agent KE-P-26 (product of Shin-Etsu Chemical Co., Ltd.) (5 parts by mass), and a colorant (0.5 parts by mass), to thereby prepare an unvulcanized silicone rubber raw material. The raw material was kneaded by means of a kneading roller. Separately, a primer was applied onto a metallic core (diameter: 20 mm). The metallic core was set in an extruder, and the unvulcanized silicone rubber was extruded around the metallic core. The plasticity degree of the unvulcanized silicone rubber was 207 before extrusion, and the extruded unvulcanized silicone rubber had a diameter of 34.5 mm.

The extrusion-molded product was allowed to stand in a refrigerator at 12° C. for 24 hours, and then subjected to primary vulcanization at 200° C. for 1 hour and secondary vulcanization at 200° C. for 6 hours. After 24 hour-cooling and before primary vulcanization, the plasticity degree was 320.

After completion of secondary vulcanization, the elastic body was cut orthogonal to the axial direction, and the rubber surface was polished, to thereby provide fixing pressure rollers. Each fixing pressure roller was found to have a diameter of 40 mm and a mean cell diameter of 88 μm. The ASKER C rubber hardness was 35°.

Example 2

The procedure of Example 1 was repeated, except that the silicone rubber was changed to KE-951-U, to thereby produce fixing pressure rollers. In Example 2, the plasticity degree of the unvulcanized silicone rubber was 202 after kneading and 314 after cooling in the refrigerator. Each fixing pressure roller was found to have a mean cell diameter of 91 μm and an ASKER C rubber hardness of 32°.

Comparative Example 1

The procedure of Example 1 was repeated, except that the extrusion-molded product was not allowed to stand in the refrigerator for 24 hours, to thereby produce fixing pressure rollers. The plasticity degree of the unvulcanized silicone rubber was 207. Each fixing pressure roller was found to have a mean cell diameter of 232 μm and an ASKER C rubber hardness of 29°.

Comparative Example 2

The procedure of Example 2 was repeated, except that the extrusion-molded product was not allowed to stand in the refrigerator for 24 hours, to thereby produce fixing pressure rollers. The plasticity degree of the unvulcanized silicone rubber was 202. Each fixing pressure roller was found to have a mean cell diameter of 323 μm and an ASKER C rubber hardness of 27°.

Summary of the Results

In Comparative Examples 1 and 2, in which the plasticity degrees were 207 and 202, the mean cell diameters were as large as 200 μm or greater and 300 μm or greater, respectively. However, in Examples 1 and 2, in which foaming vulcanization was performed after elevation of the plasticity degree to 320 or 314, the mean cell diameter was reduced to 100 μm or smaller. Thus, microcells were formed.

Test Example 1

A cross-section of each of the rubber layers of the Examples and Comparative Examples was observed under a microscope (×50), and FIG. 6 shows the results. As is clear from FIG. 6, microcells having a uniform size were observed in Examples 1 and 2.

Test Example 2

Figure 7:
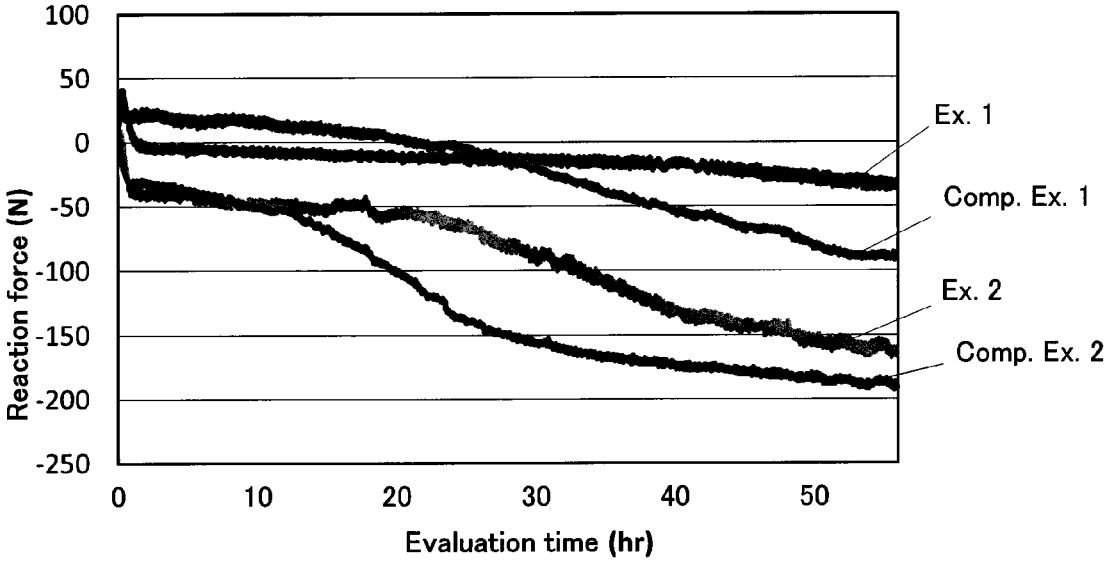
FIG. 7 is a graph showing the results of Test Example 2.

Each of the fixing pressure rollers of the Examples and Comparative Examples was set in a durability tester for fixing rollers. The test was performed at a compressibility of 30% and a rotation rate of 150 $min^{-1}$ for 56 hours under heating at 180° C. The reaction force of the test piece was measured. FIG. 7 shows the results.

As is clear from FIG. 7, the rollers of Examples 1 and 2, having a mean cell diameter of 50 μm to 150 μm, exhibited a remarkably small drop in reaction force, as compared with Comparative Examples 1 and 2.

What is claimed is:

1. A fixing pressure roller for employment in a fixing unit of a fixing device, the fixing pressure roller comprising:

a core; and an elastic layer provided around the core, the elastic layer being formed of a foamed silicone rubber which is a foam curing product of an unvulcanized silicone rubber containing a chemical foaming agent, and having a mean cell diameter of 50 μm to 150 μm, wherein the unvulcanized silicone rubber is molded, the plasticity degree of the unvulcanized silicone rubber is adjusted to 250 to 450, and then the unvulcanized silicone rubber is foaming-cured.

2. The fixing pressure roller according to claim 1, wherein the unvulcanized silicone rubber has a plasticity degree 150 or higher and lower than 250, before molding.

3. The fixing pressure roller according to claim 2, wherein the elastic layer has a release layer on a surface thereof.

4. The fixing device having a fixing pressure roller as recited in claim 3.

5. The fixing device having a fixing pressure roller as recited in claim 2.

6. The fixing pressure roller according to claim 1, wherein the elastic layer has a release layer on a surface thereof.

7. The fixing device having a fixing pressure roller as recited in claim 6.

8. The fixing device having a fixing pressure roller as recited in claim 1.

* * * * *